US005662269A

United States Patent [19]

Francis

[11] Patent Number: 5,662,269

[45] Date of Patent: Sep. 2, 1997

[54] PRESSURE WASHER WITH HEAT EXCHANGER

[76] Inventor: Dale Francis, 379 Fairfield Ave., Gretna, La. 70056

[21] Appl. No.: 528,946

[22] Filed: Sep. 15, 1995

[51] Int. Cl.[6] ..... B05B 9/00; B05B 1/24

[52] U.S. Cl. ..... 239/70; 239/124; 239/135; 134/107; 165/169

[58] Field of Search ..... 239/67, 70, 124, 239/127, 135, 139; 165/169, DIG. 345; 134/107

[56] References Cited

U.S. PATENT DOCUMENTS

| | | | |
|---|---|---|---|
| 3,018,968 | 1/1962 | Levey | 239/124 |
| 3,074,078 | 1/1963 | Varian | 134/107 X |
| 4,347,894 | 9/1982 | Gerlach | 165/169 X |
| 4,387,850 | 6/1983 | Gerber | 239/124 |

*Primary Examiner*—Andres Kashnikow
*Assistant Examiner*—Robin O. Evans
*Attorney, Agent, or Firm*—Pravel, Hewitt, Kimball & Krieger

[57] ABSTRACT

A high pressure hot water cleaning system which includes a source of water flowing to a pressure valve to allow the system to come online, providing a tank for receiving the water, the tank having an inner portion, and an outer jacket portion, a water heater, a pump for pressurizing the water, and a pressure wand for flowing the hot, pressurized water for cleaning. The system further provides a means to allow the water to cool when the wand is disengaged. This means includes a flow line from the pump to the inner tank portion of the water tank, where the hot water is cooled by the ambient water in the tank jacket portion, and returning the cooler water into the pump during the idle period. Further, there is provided a timer which is activated by a flow switch when the water flow is interrupted, so that after a period of time of idle time, the system is automatically shut down and must be manually reactivated.

8 Claims, 2 Drawing Sheets

PRESSURE WASHER WITH HEAT EXCHANGER

BACKGROUND OF THE INVENTION

1. Field of the Invention

The present invention relates to high pressure hot water washers. More particularly, the present invention relates to a hot water high pressure washing system incorporating a heat exchanger therein working in combination with a timer mechanism to reduce the temperature of the water when the washer is idle over a given period of time.

2. General Background

In the art of high pressure washers for cleaning grease, oil, or other compounds, such as dried oil-based muds from mechanical components, as for example, rig machinery, or the like, it is necessary that in addition to the water being at high pressures, that the water be heated, to a temperature, for example 150 degrees Fahrenheit. Such cleaning systems currently in the art utilize water from a source entering the system, and engaging a pressure switch in order to activate the system. The water flows to a water heater for heating the water to the desired temperature. The heated water then enters a pump, which pressures the water stream, so that when a pressure washer wand is manually activated, the high pressure stream of hot water flows from the wand and cleans the component to be cleaned. However, oftentimes, during cleaning, the person operating the wand, must interrupt the work for lengths of time. During this time the hot water continues to circulate within a closed loop in the head of the pump until the pressure wand is reactivated, unless the water source is turned off. The problem with this arrangement is that the water will continue to be circulated at that high temperature and will then "spike" at a much higher temperature, e.g. 180 degrees fahrenheit, during the closed loop cycle. This spiking causes damage to the internal seals, etc. of the pump head and usually results in shortening the life of the pump and ultimately incapacitating the pump.

The problem cannot always be avoided simply by turning off the source of water to the pump, since this is not always a convenient means to operate the system. In order to avoid damage to pumps, what is needed is a means to reduce the temperature of the water sufficiently so that the pump system is not damaged while the pump is in idle, but does not require shutting down the water source entirely.

SUMMARY OF THE PRESENT INVENTION

The apparatus and system of the present invention solves the problems in the art in a simple and straightforward manner. What is provided is a high pressure hot water cleaning system which includes a source of water flowing at ambient temperature to a pressure valve to allow the system to come online; providing a tank for receiving the water, the tank having an inner portion, and an outer jacket portion; providing a water heater; a pump for pressurizing the water, a pressure washer wand for receiving the pressurized water from the pump, for cleaning. The system further provides a means to allow the pump to cool when the wand is manually disengaged. This means includes a flow line extending from the pump to the inner portion of the water tank, where the hot water is cooled by the ambient water in the outer tank jacket portion, before it returns to the pump and is recirculated during the idle period. Simultaneously, a flow switch senses the interruption in the water flow, and automatically activates a timer, so that after a period of idle time, the timer automatically shuts down the system which must be manually reactivated.

Therefore, it is a principal object of the present invention to provide a high pressure hot water cleaning system which allows for immediate cooling down of the water flowing over the pump head the instant idle time begins;

It is a further principal object of the present invention to provide a heat exchange mechanism in the system so that when the system is idle, the hot water flowing over the pump is cooled sufficiently to eliminate heat spike damage to the pump head;

It is a further object of the present invention to provide a high pressure hot water cleaning system which includes a flow switch to deactivate a timer working in conjunction with a heat exchanger, so that when the system is put on idle, the timer is activated by the flow switch to allow the system to remain idle for a certain period of time until the system is automatically shut down, yet during the idle time period, maintaining the water at a sufficiently low temperature to eliminate the potential of damage to the components within a system pump during the idle time.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
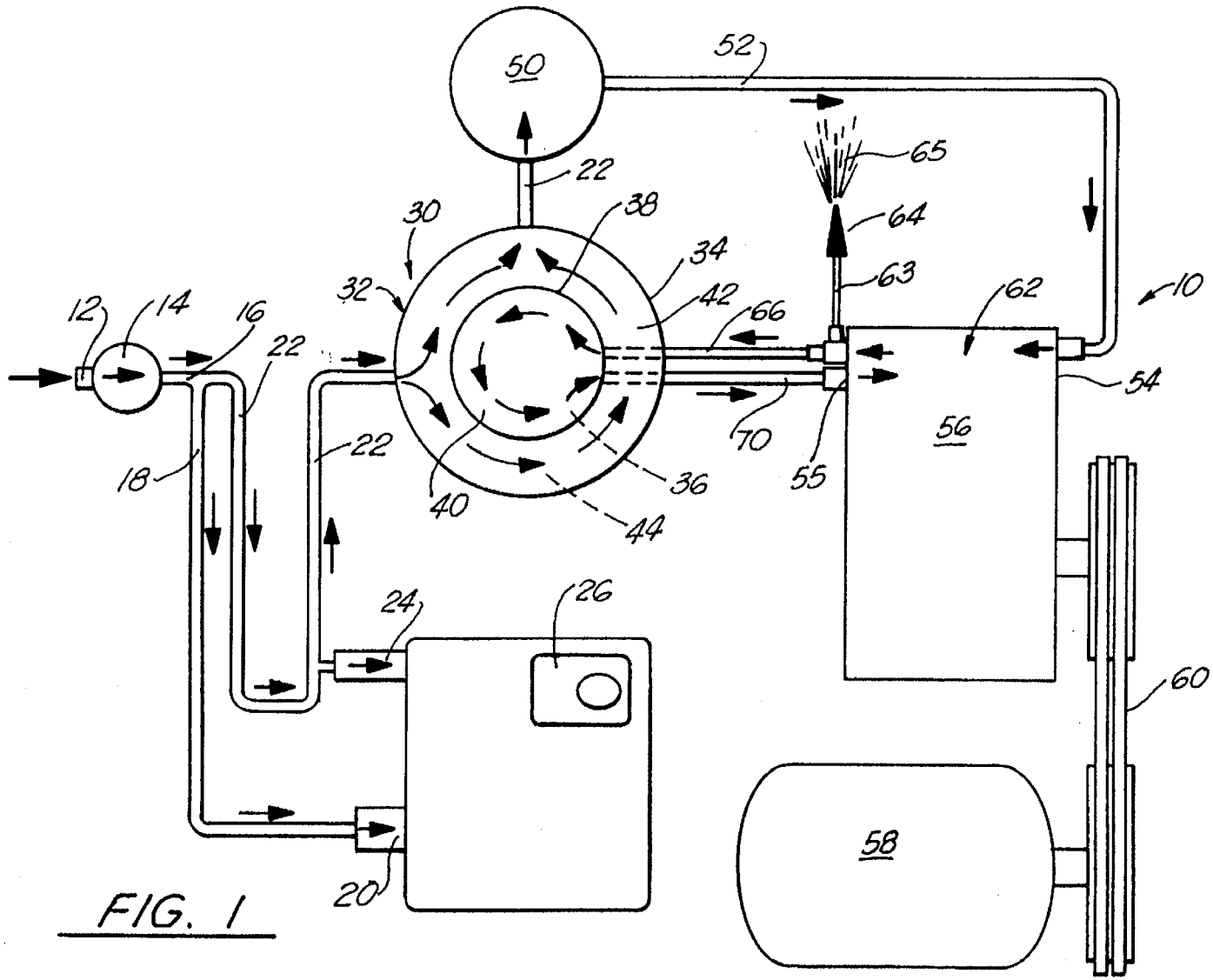
FIG. 1 illustrates an overall schematic view of the system currently in use in the art.

FIG. 1 illustrates the preferred embodiment of the apparatus and system of the present invention by the numeral 10. Prior to a discussion of the current invention, reference is made to FIG. 2, which illustrates in schematic view a prior art system which is currently in use in the art. This system will be referenced as System 100.

Figure 2:
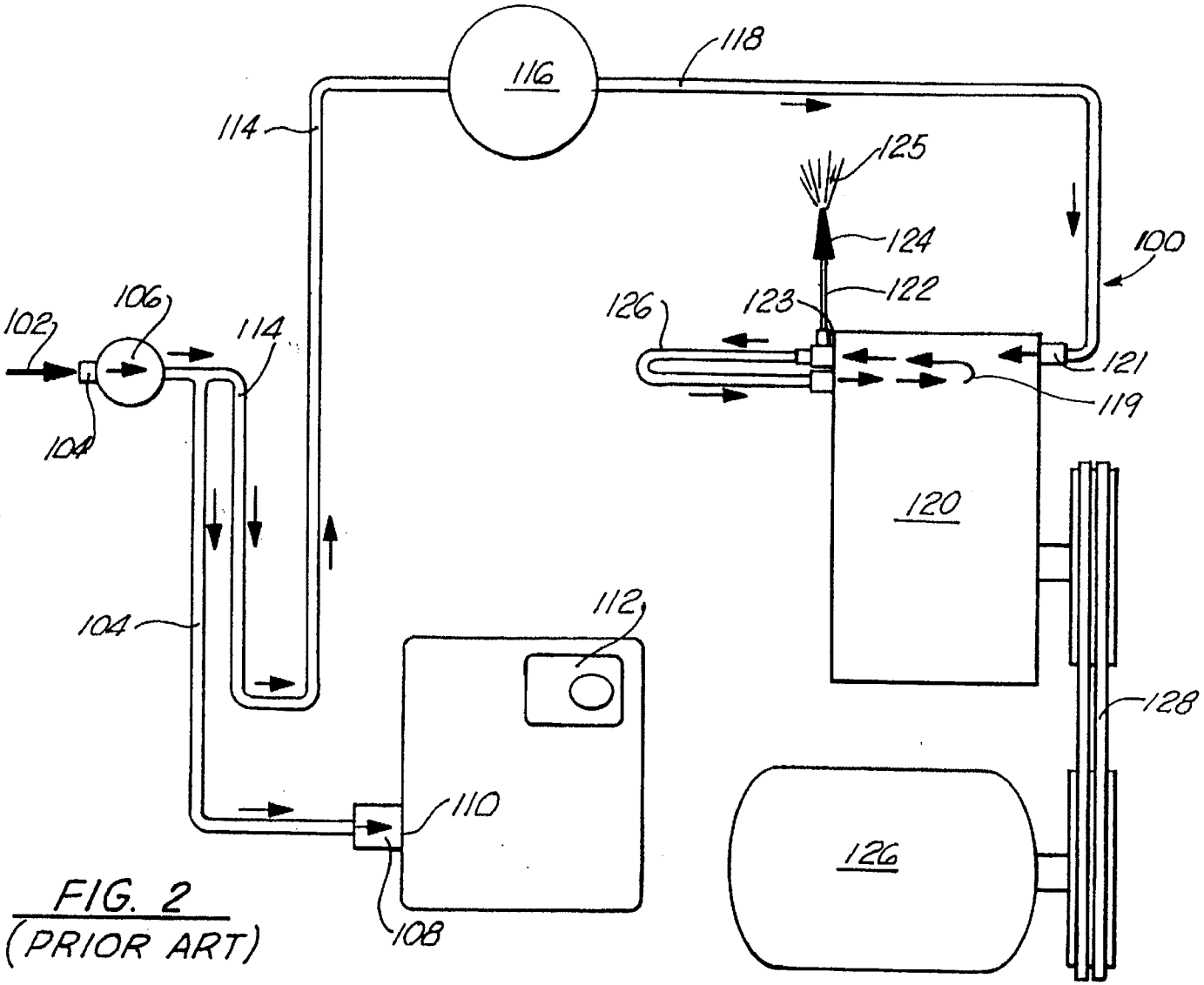
FIG. 2 (PRIOR ART)
FIG. 2 illustrates an overall schematic view of the preferred embodiment of the system of the present invention.

As illustrated in FIG. 2, System 100 includes a source of water (arrow 102) entering through a flow line 104, and a flow valve 106. The water flows to a sensor means 108, which senses the pressure within flow line 104, of the water therein. In normal circumstances, this pressure sensor 108 is utilized to activate the System 100, when the pressure of the water is at least fifteen pounds per square inch at point 110. In addition to the pressure sensor, there is usually a manually activated timer 112, which is utilized to shut the system down at a specific time set manually by the operator. Following the sensing of the water pressure in line 104, by pressure sensor 108, the system becomes operable, and water will then flow through second branch of flow line 114, to a water heater 116. Water heater 116, is of a type that can be commercially obtained, and is utilized to heat the water to a temperature of approximately 150 degrees fahrenheit. The water then exits water heater 116 through flow line 118, and enters the pumping unit 120 at the low pressure side 121. The pump 120 comprises a standard single stroke piston-driven pump, which increases the pressure of the water flowing over the pump head 119, and out of the high pressure side 123 of the pump via line 122. The pressurized water would flow to pressure washer wand 124, so that the hot pressurized water 125 is able to clean components that may be ladened with oil or other types of debris. The pump 120 would be driven by an electric motor 126, as seen via belt members 128, to operate the piston driven pump. As was explained earlier, this system is quite common in the art, and has significant shortcomings.

As further illustrated in FIG. 2, when the user of the pressure wand 124 must interrupt use, wand 124 is turned off, and the water cannot exit wand 124, but is diverted into a closed loop 127, which then allows water to continue to circulate within the closed loop 127 and through the head 119 of the pump 120 during nonuse. The problem with such a system is that over a given amount of time, the water which is entering the pump at 150 degrees and which continues to circulate within the pump head, tends to increase in temperature, and cause a "spiking" of the water in the neighborhood of 180 degrees fahrenheit. When this occurs, the components within the pump head 119, such as the packing and other types of seals, would tend to crystalize and eventually disintegrate under the continuous heat. Therefore, over time the life of pump 120 is reduced significantly, and therefore the pump 120 must be discarded and replaced at a time much earlier than what could be its life span.

FIG. 1 illustrates the improved system of the present invention to overcome this and other problems. What is provided in system 10 is a water inlet line 12, flowing through a water intake valve 14, and into a principal flow line 16. Water in flow line 16 is then diverted into a first flow line 18 which engages a pressure sensor 20. As in the prior art, the pressure sensor 20 is so rated so that if the water is at least 15 degrees per square inch in pressure, the pressure sensor 20 will activate the system for use as seen in FIG. 1. Further, water is diverted into a second flow line 22, which allows it to flow through a flow switch 24, which flow switch is positioned in line with a timer 26. As long as water is flowing through flow switch 24, which indicates that the system is in use, then the timer 26 will remain inactive. Once the water stops flowing within line 22, for reasons which will be explained further, the timer 26 then will automatically be set at thirty minutes and after a thirty minute time span, the timer 26 will cause the entire system to shut down. This will be explained further.

Returning now to the system itself, after the water has flowed past flow switch 24, through line 22, it then enters a heat exchange means 30. This heat exchange means comprises a tank 32, having a first annular wall 34, and an inner tank space 36, having an interior annular wall 38. The interior annular wall 38, defines an inner cooling tank 40, and there is defined an outer cooling tank 42 in the annular space 44 between the first annular wall 34 and the interior wall 38. As illustrated in FIG. 1, water flowing through line 22, fills the outer jacket 42. The water in outer jacket 42 then flows into a water heater 50, while the water in inner tank 40 remains idle and cooled at ambient temperature. Water heater 50, as in the prior art, is a convention heater, which heats the water up to at least 150 degrees fahrenheit and is usually heated via an electric coil or the like to avoid any explosions in the system which may occur through open flames. Once the water is heated to the proper temperature, it flows via exit flow line 52 into the low pressure side 54 of pump 56. Again, pump 56 is a convention type pump as is utilized in the prior art, and is driven by an electric motor 58, via belt members 60, to operate a piston within pump 56, for pressurizing the water therein. After the water has entered the head 62 of pump 56, it exits on the high pressure side 55 of pump head 62. The pressurized water then flow through line 63 so that when pressure wand 64 is activated, hot water 65 flows from wand 64, under pressure to clean the components that need to be cleaned.

In the event that the user of the system must interrupt the flow of water, once the wand 64 is released and water can no longer flow through wand 64, the water is then diverted into a first line 66, which allows the water to flow into inner tank 40, which contains cool water. This water entering the inner tank 40 is approximately 150 degrees fahrenheit but cools down and returns back through return line 70 into pump head 62. As is seen from the drawing in FIG. 1, the inner tank 40 is surrounded by ambient temperature water which is flowed from the flow line 22 into the outer tank jacket 42 prior to it entering the heater 50. Therefore, as the heated water flows from the pump head 62 through line 66 into the inner tank 40, there is a heat exchange effect between the inner tank 40 and the outer tank jacket 42, with the ambient temperature in the outer tank jacket 42 lowering the temperature of the water in the inner tank 40 within seconds. When this is accomplished, the water then returning and recirculating through the head 62 of pump 56 is much cooler and reduces the temperature of the head to a temperature of 110 to 120 degrees fahrenheit, and therefore does not result in any damage to the pump head 62, since the components of the pump head 62 are rated for such high temperatures.

As was stated earlier, when pressure wand 64 is deactivated, there is no longer water flowing through line 22, and therefore the flow switch 24, when sensing the non-flow of water, immediately activates the timer 26 for a thirty minute time cycle. During this thirty minutes of non-use, the heat exchanger 30 maintains the water at the desired level below 150 degrees fahrenheit. At the end of the thirty minutes, the timer goes off and the system is automatically shut down so that the water is no longer being heated. In order to be brought back on line, the system will have to be manually reactivated. Should the user of the system return within that thirty minute time cycle and the nozzle is re-engaged, then the pressure sensor 20 will sense the flow of water and will reactivate the system with the timer 26 being reset back at thirty minutes until the flow switch 24 would activate it once more.

Therefore, it is important to understand that the heat exchanger 30 enables the user of the system to interrupt use for a given period of time, i.e. thirty minutes, without the system shutting down. However, during this period of nonuse, the heated water within the system, i.e., particularly in the pump area, is reduced in temperature via the heat exchanger 30 in the inner tank 40 and the outer tank jacket 42 in order to protect the life of the pump. In addition, and as important, is the fact that the flow switch 24, when sensing the interruption and flow of water through it, will automatically activate the thirty minute timer 26. This is a critical part of the combination in view of the fact that without the thirty minute timer 26, the heat exchange portion of the system would continue to do its job. However, over an extended period of time there would eventually result in the water temperature continuing to get gradually higher and ultimately spiking as in the current state of the art. Therefore it is critical that the flow switch and timer work in conjunction with the heat exchanger to establish a system that is vastly improved over the current state of the art.

Certain components in the system are standard off the shelf items, such as the water heater which utilizes an electric 440 volt heating element. The system is further explosion proof. i.e., the flow switches that are activated are all electronic, and the timer is enclosed inside an explosion-proof enclosure.

The following table lists the part numbers and part descriptions as used herein and in the drawings attached hereto.

PARTS LIST

| Description | Part No. |
|---|---|
| system | 10 |
| inlet line | 12 |
| intake valve | 14 |
| principal flow line | 16 |
| first flow line | 18 |
| pressure sensor | 20 |
| second flow line | 22 |
| flow switch | 24 |
| timer | 26 |
| heat exchange means | 30 |
| tank | 32 |
| first annular wall | 34 |
| inner tank space | 36 |
| inner annular wall | 38 |
| inner cooling tank portion | 40 |
| outer tank jacket | 42 |
| annular space | 44 |
| water heater | 50 |
| flow line | 52 |
| low pressure side | 54 |
| high pressure side | 55 |
| pump | 56 |
| electric motor | 58 |
| belt members | 60 |
| pump head | 62 |
| flow line | 63 |
| pressure water wand | 64 |
| hot water | 65 |
| first line | 66 |
| return line | 70 |
| system | 100 |
| arrow | 102 |
| flow line | 104 |
| flow valve | 106 |
| sensor means | 108 |
| point | 110 |
| timer | 112 |
| flow line | 114 |
| water heater | 116 |
| flow line | 118 |
| pump head | 119 |
| pumping unit | 120 |
| line | 122 |
| high pressure side | 123 |
| pressure washer wand | 124 |
| hot water | 125 |
| electric motor | 126 |
| closed loop | 127 |
| belt members | 128 |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A high pressure hot water cleaning system, comprising:

a) a water flow line for introducing water into the system at ambient temperature;

b) tank means for receiving the water through the flow line, the tank means comprising a first inner portion and a second outer jacket portion;

c) a water heater for receiving the water flowing from the tank jacket portion for heating the water up to a temperature of at least 150 degrees fahrenheit;

d) a pump for receiving the water flowing from the water heater and pressurizing the water to be used in the system;

e) a flow line for diverting pressurized water into the inner tank, to reduce the temperature of the water through heat exchange with the ambient temperature water in the outer tank jacket, and to return the water from the inner tank to the head of the pump, to reduce the temperature of the water within the pump head below 150 degrees fahrenheit; and f) means for activating a timer in a time cycle, so that at the end of the time cycle, the system is automatically deactivated.

2. The system in claim 1, wherein the means for activating the timer in a time cycle comprises a flow switch engaged to the timer.

3. The system in claim 1, wherein the timer is set in a thirty minute time cycle.

4. The system in claim 1, wherein following the deactivation of the system, the system must be manually reactivated.

5. An improved high pressure hot water cleaning system of the type having a water flow line for introducing water into the system at ambient temperature; a water heater for receiving the water flowing from the tank jacket portion for heating the water up to a temperature of at least 150 degrees fahrenheit; a pump for receiving the water flowing from the water heater and pressurizing the water; and a pressure wand for receiving the pressurized water for cleaning, the improvements comprising:

a) tank means for receiving the water through the flow line, the tank means comprising a first inner portion and a second outer jacket portion;

b) means, when the water flow is interrupted, for diverting pressurized water from the pump into the inner tank to reduce-the temperature of the water through heat exchange with the ambient temperature water in the outer tank jacket, and to return the water from the inner tank to the head of the pump, to reduce the temperature of the water within the pump head below 150 degrees fahrenheit; and c) means for activating a timer in a time cycle, so that at the end of the time cycle, the system is automatically deactivated.

6. The improved system in claim 5, wherein the means for activiting a timer in a time cycle comprises a flow switch means.

7. The system in claim 5, wherein the means for diverting the water from the pump into the inner tank comprises a flow line extending from the pump, head into the inner tank portion of the tank means.

8. The system in claim 5, wherein following the deactivation of the system, the system must be manually reactivated.

* * * * *